United States Patent [19]

Bronner et al.

[11] 3,974,387

[45] Aug. 10, 1976

[54] X-RAY DIAGNOSTIC APPARATUS INCLUDING MEANS FOR REGULATING THE X-RAY TUBE VOLTAGE THROUGH THE X-RAY TUBE CURRENT

[75] Inventors: Karlheinz Brönner, Erlangen; Ulrich Grassme, Nurnberg; Eickhardt Söder, Erlangen, all of Germany

[73] Assignee: Siemens Aktiengesellschaft, Erlangen, Germany

[22] Filed: Apr. 17, 1975

[21] Appl. No.: 569,088

[30] Foreign Application Priority Data

May 10, 1974 Germany ..... 2422844

[52] U.S. Cl. ..... 250/409; 250/421

[51] Int. Cl.[2] ..... H05G 1/34

[58] Field of Search ..... 250/421, 409, 402

[56] References Cited

UNITED STATES PATENTS

| | | | |
|---|---|---|---|
| 3,828,194 | 8/1974 | Grasser | 250/402 |
| 3,894,235 | 7/1975 | Franke | 250/409 |

FOREIGN PATENTS OR APPLICATIONS

| | | |
|---|---|---|
| 1,930,714 | 1/1971 | Germany |

*Primary Examiner*—Alfred E. Smith
*Assistant Examiner*—T. N. Grigsby
*Attorney, Agent, or Firm*—Haseltine, Lake & Waters

[57] ABSTRACT

An X-ray diagnostic apparatus in which the X-ray tube voltage is regulated through intermediary of the X-ray tube current. In the apparatus, a regulator is situated within a regulating circuit for the effective value of the filament current of the X-ray tube, and influences the effective value of the filament current for the purpose of correlating the actual value with the reference value which has been determined through the preset X-ray tube voltage. In the inventive X-ray diagnostic apparatus, on the one hand, the actual value of the X-ray tube voltage is compared with a reference value, and the filament current is influenced for the purpose of correlating the actual value to the reference value. Furthermore, the filament current which is required for a predetermined reference value of the X-ray tube voltage is also maintained constant preceding the beginning of an exposure so that, at the initiation of an exposure, the filament current already lies at least near to the correct value. Deviations of the X-ray tube voltage from the correct value are thereby smaller than in prior art apparatus.

5 Claims, 8 Drawing Figures

X-RAY DIAGNOSTIC APPARATUS INCLUDING MEANS FOR REGULATING THE X-RAY TUBE VOLTAGE THROUGH THE X-RAY TUBE CURRENT

FIELD OF THE INVENTION

The present invention relates to an X-ray diagnostic apparatus in which the X-ray tube voltage is regulated through intermediary of the X-ray tube current.

DISCUSSION OF THE PRIOR ART

An X-ray apparatus is presently known from German Laid-Open Patent No. 1,930,714 having a fixed idling or no-load output voltage of a high-voltage transformer thereof and a control or regulating circuit for the X-ray tube voltage which contains a comparison element for comparing the actual value of the X-ray tube voltage with a reference value, as well as a regulator which is controlled by the output signal of the comparison element for the effective value of the filament current at the X-ray tube for correlating the actual value of the X-ray tube voltage to the reference value. In this known X-ray diagnostic apparatus it is possible to regulate the X-ray tube voltage through the X-ray tube current for a single idling output voltage of the high voltage transformer. Hereby, the regulation is carried out through the filament current of the X-ray tube to which there corresponds to the X-ray tube current. The voltage drop-off at the internal resistance of the X-ray apparatus thereby so adjusts itself that the currently desired X-ray tube voltage lies at the X-ray tube.

In the known X-ray diagnostic apparatus, the supply voltage oscillations effect themselves on the X-ray tube voltage, on the one hand directly through the high-voltage transformer and, on the other hand indirectly, through the filament current. This has the result that immediately after the initiation of an X-ray exposure, under circumstances, a relatively long time period may pass until deviations of the X-ray tube voltage from the desired reference value are finally regulated. The exposure periods, however, frequently lie within a range in which over or under voltage of the X-ray tube, which occur due to the delayedly applied regulation at the initiation of an exposure, may exert a negative effect on the picture quality.

SUMMARY OF THE INVENTION

Accordingly, it is an object of the present invention to provide an X-ray diagnostic apparatus of the above-mentioned type, in which deviations of the X-ray tube voltage from the desired reference value are regulated within a short period in comparison with the shortest exposure time, so as to exert practically no effect on the picture quality.

The foregoing object is inventively attained in that the regulator is situated within a regulating circuit for the effective value of the filament current of the X-ray tube, and influences the effective value of the filament current for the purpose of correlating the actual value with the reference value which has been determined through the preset X-ray tube voltage. In the inventive X-ray diagnostic apparatus, on the one hand, the actual value of the X-ray tube voltage is compared with a reference value, and the filament current is influenced for the purpose of correlating the actual value to the reference value. Furthermore, the filament current which is required for a predetermined reference value of the X-ray tube voltage is also maintained constant preceding the beginning of an exposure, so that, at the initiation of an exposure, the filament current already lies at least near to the correct value. Deviations of the X-ray tube voltage from its reference value are thereby smaller than in the known X-ray diagnostic apparatus, and may be regulated more rapidly.

In accordance with a further feature of the invention, the X-ray diagnostic apparatus includes a threshold value element having a switch connected thereto in the filament circuit, and including a timer which will switch the switch, immediately after receiving an exposure command, continually into its low-ohmic condition during a time period which is short in comparison with the transition time between the transillumination and exposure. Immediately after the exposure command, this will then result in a rapid heating up of the heating filament of the X-ray tube so as to assure, in each instance, after the completion of the transition time between the transillumination and exposure, which is essentially determined through the time required for the acceleration of the rotary anode, that the correct filament current will flow through the X-ray tube.

BRIEF DESCRIPTION OF THE DRAWINGS

Further advantages and details of the invention may now be ascertained from the following description of an exemplary embodiment thereof, taken in conjunction with the accompanying drawings; in which.

DETAILED DESCRIPTION

Figure 1:
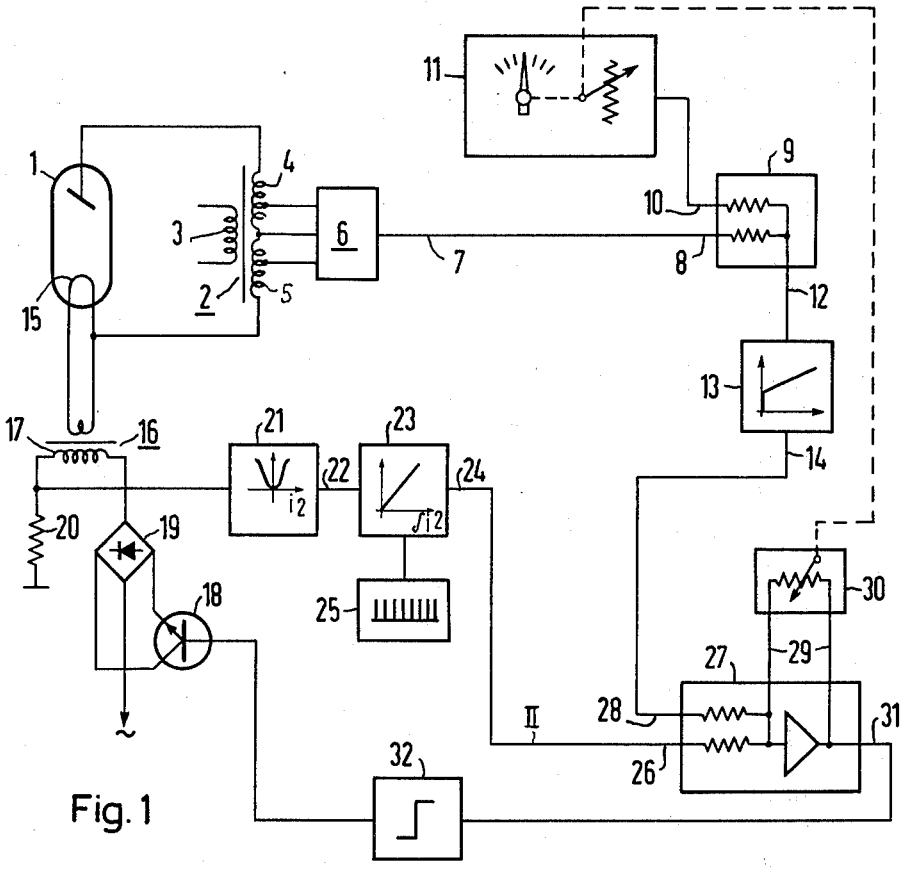
FIG. 1 illustrates a circuit diagram for an X-ray diagnostic apparatus constructed pursuant to the invention.

Illustrated in FIG. 1 of the drawings is an X-ray tube 1 which is supplied from a high-voltage transformer 2. The primary winding 3 of the high-voltage transformer is adapted to be connected to a suitable power supply in a manner which is not shown. The secondary winding portions 4 and 5 of the transformer have an actual value transmitter 6 associated therewith. The actual-value transmitter 6 delivers a direct voltage at its output 7 which is proportional to the peak value of the highvoltage at the X-ray tube 1. This signal is transmitted to the actual-value input 8 of a comparison element 9. The comparison element 9 possesses a reference-value input 10, to which there is transmitted a direct voltage generated by a reference-value transmitter 11, and which embodies the reference value of the peak voltage at the X-ray tube 1. The comparison element 9 delivers a signal at its output 12 which corresponds to the difference between the signals at its inputs 8 and 10, and which controls a proportional-integral regulator 13. The signal at the output 14 of the PI-regulator 13 remains constant at its present value when the signal at its input 12 is zero, and varies when a control signal appears at its input 12.

The heating filament 15 of the X-ray tube 1 is connected to a filament transformer 16, whose primary winding 17 is adapted to be connected to the power supply circuit through intermediary of a switching transistor 18 and a diode bridge 19. The components 18 and 19 formulate a bipolar switch, meaning, that upon switching of the switching transistor 18 into its low-ohmic condition, both half-waves of the power supply alternating voltage are connected to the primary winding 17. Located in series connection with the primary winding 17 is a measurement resistance 20, from which there is tapped-off a voltage which is then transmitted to a squaring element 21. The voltage at the resistance 20 is proportional to the present value of the filament current of the X-ray tube 1. Accordingly, at the output 22 of the squaring element 21 thereby lies a voltage which corresponds to the square of the instantaneous value of the filament current of the X-ray tube 1. This voltage is transmitted to an integrator 23 which delivers a signal at its output 24 corresponding to the integral of its input voltage. The integrator 23 is switched over into its zero condition at the end of each half-wave of its input voltage through the use of a synchronizing arrangement 25, so that the voltage at its output 24 corresponds to the actual value of the filament current effective value of the X-ray tube 1. This voltage is transmitted to the input 26 of an amplifier 27. The amplifier 27 possesses two control inputs 28 and 29. By means of the control inputs 28 and 29, the amplification of the amplifier 27 is adjustable. At the input 28 there is applied the output signal of the PI-regulator 13, whereas at the input 29 there is applied a signal which is delivered by a reference value transmitter 30 for the filament current of the X-ray tube. The output signal of the amplifier 27 is conveyed through a conductor 31 to a flip-flop 32 possessing fixed control threshold, and which controls the transistor 18.

The flip-flop 32 always reverses when its input voltage reaches its threshold and thereby effects the deactivation of the transistor 18 and, as a result, the separation of the primary winding 17 from the power supply. The amplification of the amplifier 27 is so adjusted through the signal at the input 29, that the threshold of the flip-flop 32 is reached by the signal in the conductor 31 when the effective value of the filament current, meaning the signal at input 26, has that particular value which is predetermined through the X-ray tube voltage preset at the reference value transmitter 11. The filament current of the X-ray tube 1, and consequently the X-ray tube current, is thereby so regulated through the signal at the input 29 also for a switched-off X-ray tube 1, meaning, for a not applied high-voltage of the X-ray tube 1 that, at the instant of the switching-in of the X-ray tube 1, there flows an X-ray tube current which precisely corresponds to the set reference value of the X-ray tube voltage. The X-ray tube voltage hereby is obtained from the fixed idling or no-power output voltage of the high-voltage transformer 2, and the voltage drop-off at the internal resistance of the X-ray apparatus and the power supply due to the X-ray tube current. To each X-ray tube voltage there thus belongs a predetermined X-ray tube current, and thereby also a predetermined filament current of the X-ray tube which determines the X-ray tube current. Power supply voltage oscillations preceding the switching-in of the X-ray tube 1 are thereby eliminated through the regulating of the filament current of the X-ray tube, so that at the moment of the switching-in of the X-ray tube 1, there will flow the X-ray tube current which is associated with the preset X-ray tube voltage.

If the X-ray tube voltage varies during the sequence of an X-ray photograph or exposure, meaning, after the switching-in of the high voltage, for example, as a result of power supply voltage oscillations, than a signal appears at the output 12 of the comparison element 9 which so influences the PI-regulator 13 that the latter, through a signal at the output 14, and thereby at the input 26 of the amplifier 27, will vary the amplification of this amplifier. Thereby, the threshold of the threshold element which is constituted of components 27 and 32 is so changed that the filament current of the X-ray tube assumes such a value at which the X-ray tube voltage is regulated to the reference value preset at the reference value transmitter 11.

Figure 2:
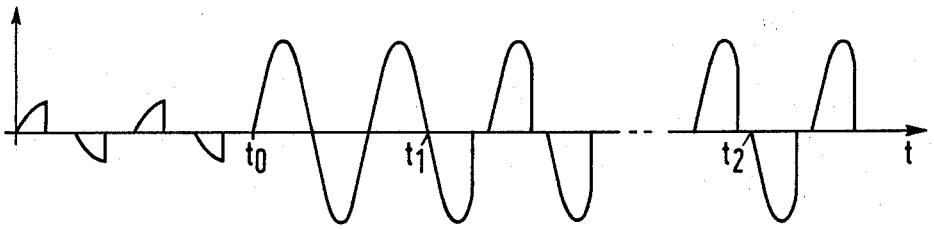
FIG. 2 illustrates the voltage cycle at the location II in FIG. 1.

Illustrated, by way of example, in FIG. 2 is the timewise cycle of the filament current of the X-ray tube. At the timepoint *t*0 thereby is issued the exposure command. Prior to the timepoint *t*0 there is carried out a transillumination with the X-ray diagnostic apparatus, and a filament current is preset through a phase gating control arrangement. At the timepoint *t*0, the transistor 18 is continually connected through for three half-periods, so that there results a rapid heating up of the heating filament of the X-ray tube 1. In this sense, the control of the switching transistor 18 may be effected through a timer which is started at timepoint *t*0 and reversed at timepoint *t*1, meaning, after the completion of three half-periods, as is described in greater detail hereinbelow. From timepoint *t*1 on, the filament current of the X-ray tube is now regulated in correspondence with the X-ray tube voltage which is set at the reference value transmitter 11. At the input 29 of the amplifier 27 there lies a reference value signal for the effective value of the filament current of the X-ray tube, which produces an X-ray tube current, which, at the actuation of the X-ray tube 1, has the result of the X-ray tube voltage set at the reference value transmitter 11. The voltage at the input 26 of the amplifier 27 thereby increases until the effective value, which is predetermined by the signal at the input 29, has been reached. At this timepoint the flip-flop 32 reverses and separates or disconnects the primary winding 17 from the power supply. At timepoint *t*2 the requirement for the connection of the highvoltage to the X-ray tube 1 are fulfilled, in particular the rotary anode of the X-ray tube 1 has reached its final rotational speed, and the X-ray tube 1 is actuated. From this timepoint *t*2 on, in the manner described, the amplification of the amplifier 27 additionally is so influenced through the output signal of the PI-regulator, that deviations of the X-ray tube voltage are regulated from the value which is preset at the reference value transmitter 11. After the completion of the exposure time, the exposure is terminated through deactivation of the X-ray tube 1. At this timepoint transition may again be effected to transillumination.

It is essential for the present invention that, in addition to the regulation of the X-ray tube voltage by means of the X-ray tube current and thereby the filament current of the X-ray tube during an exposure commencing from the beginning of the exposure command, there also already during the transition period between transillumination and exposure, there be carried out a regulation of the filament current of the X-ray tube on the basis of reference value which is preset through the adjusted exposure voltage, and that this regulation also be continued during the exposure. Deviations of the X-ray tube voltage from its set reference value at the beginning of an exposure thereby are only minute. In the inventive object two regulating circuits thus complement themselves, through which there regulated effects transmitted from power supply voltage oscillations to the filament current of the X-ray tube, and directly to the X-ray tube voltage through the high-voltage transformer.

Figure 3:
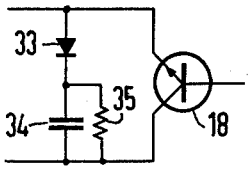
FIGS. 3 through 8, respectively, illustrate various details of the circuit diagram shown in FIG. 1.

The switching transistor 18 serves for the switching of an inductive charge or load, namely the heating filament transformer 16. Upon the switching-off of this load, voltage peaks occur which may endanger the switching transistor 18. Hereby, according to FIG. 3, located in parallel with the operating path of the switching transistor 18 is the series conduit of a diode 33 and the parallel circuit of a condensor 34 and of a discharge resistance 35. Switch-off voltage peaks are assumed by the condensor 34, so that the switching transistor 18 is thereby no longer endangered. At a deactivated heating filament transformer 16, the diode 33 prevents the condensor 34 from discharging through the operating path of the switching transistor 18 so as to endanger in this manner this transistor. The discharge of the condensor 34 is effectuated through the discharge resistance 35.

Within the scope of the invention, the regulation of the effective value of the filament current of the X-ray tube may also be carried out indirectly through intermediary of the filament voltage or filament power output.

Figure 4:
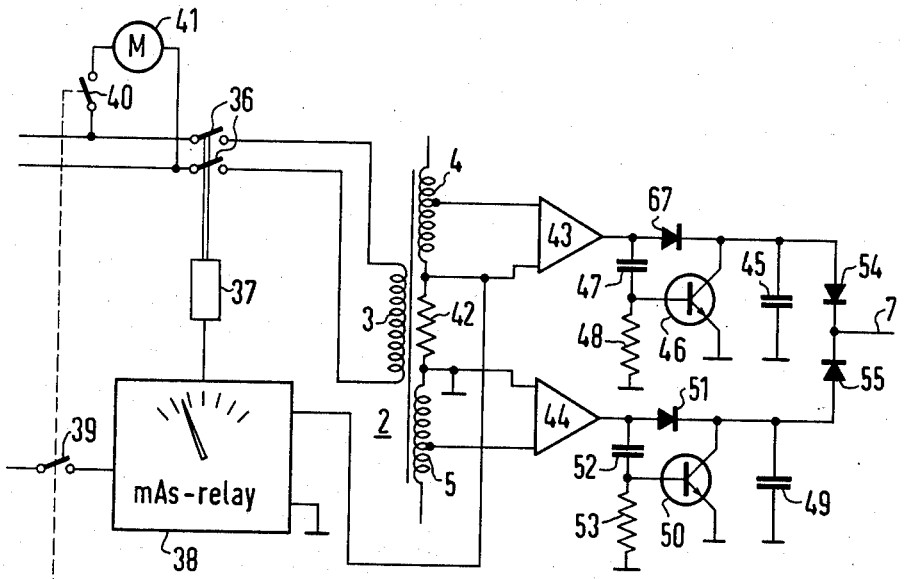

FIG. 4 illustrates the circuit arrangement of the primary circuit and the actual value transmitter 6. Located in the primary circuit are the contacts 36 of a protector or relay, whose winding 37 is controlled by an mAs-relay 38. Associated with the mAs-relay 38 is a contact 39 of an exposure trigger, the latter of which includes a further contact 40. By means of the contact 40 there is actuated the motor 41, which drives the anode of the X-ray tube.

The mAs-relay 38 receives a voltage corresponding to the X-ray tube current from a measuring resistance 42 which is connected in series with the secondary winding portion 4 and 5, and integrates this voltage with respect to time, meaning, it forms the mAs-product and compares it with a preset reference value. As soon as the reference value is reached, the winding 37 is disconnected from its supply voltage source through intermediary of the mAs-relay 38, so as to open the contacts 36.

Tapped-off at the winding portions 4 and 5 are voltages which correspond to the X-ray tube voltage, and which run at an 180° phase displacement with respect to each other. These voltages are transmitted to two amplifiers 43 and 44. The output signal of the amplifier 43 is rectified through a diode 67, and charges a condensor 45. The condensor 45 is discharged through a switching transistor 46 at the beginning of each positive half-wave of the voltage which is tapped-off at the winding portion 4. For this purpose the switching transistor 46 is connected to an RC-element 47, 48.

Figure 5:
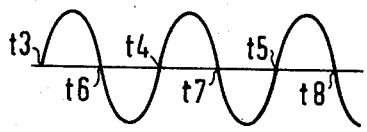

FIG. 5 shows, for example, the sequence of the input voltage for the operational amplifier 43. At the time points *t*3, *t*4 and *t*5, the condensor 45 is discharged so that there is located therein a voltage from before the beginning of a positive half-wave of the voltage tapped-off at the winding portion 4 until the beginning of the next positive half-wave, which embodies the peak value of the interim occurring X-ray tube voltage. Analogously therewith runs the voltage at the condensor 49 which is discharged by means of a switching transistor 50 at timeponts *t*6, *t*7 and *t*8, and which is charged through a diode 51 with the output voltage of the amplifier 44. The switching transistor 50 is periodically connected through by means of an RC-element 52, 53. The peak value of a negative half-wave, according to FIG. 5, is thereby stored by the condensor 49 until the beginning of the subsequent half-wave. Through the diodes 54 and 55, the output voltages of the condensers 45 and 49 are superimposed, so that a voltage lies in the conductor 7 which may be quite readily smoothed and will represent the cycle of the peak value of the X-ray tube voltage.

Figure 6:
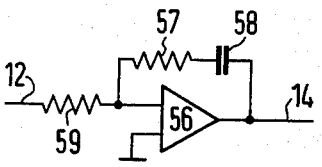

The PI-regulator 13, according to FIG. 6, contains an operational amplifier 56 which is coupled back through an RC-element 57, and thereby delivers an output signal which retains its present value when the input signal reconveyed to the coupling resistance 59 is zero, and whose value varies when this input signal deviates from zero.

The squaring member 21 may be a multiplier which multiplies the two input signals with each other, whereby these two input signals are the signal which is tapped-off at the measuring resistance 20.

Figure 7:
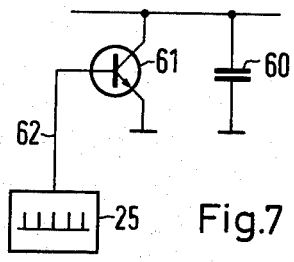

The integrator 23, according to FIG. 7, possesses an integrating condensor which is switched over into its zero condition by means of a switching transistor 61 at the end of each half-wave of its input voltage. The switching transistor 61 is controlled by an impulse generator which forms the synchronizing arrangement 25, and which delivers a small output impulse to the conductor 62, at each zero through passage of the supply voltage. The synchronizing arrangement 25 hereby may include a differentiating element for the power supply voltage.

Figure 8:
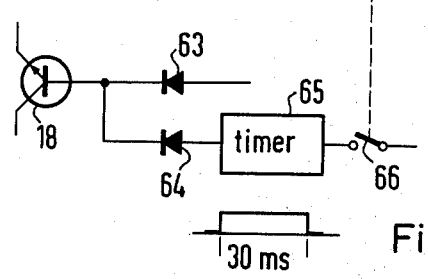

Illustrated in FIG. 8 is a control input of the transistor 18, which is connected through a diode 63 to the output of the flip-flop 32, and through a diode 64 to a timer switch 65. The diodes 63 and 64 form an OR-gate. The timer switch 65 is started upon the actuation of a contact 66 and delivers a continual impulse lasting approximately 30 milliseconds to the base of the transistor 18. During the sequence of this impulse, the transistor 18 is continually connected through, so that there is afforded a rapid heating up of the heating filament of the X-ray tube 1.

In summation, it is thus ascertained that, for the production of an X-ray exposure or photograph, the contacts 39, 40 and 66 are closed. The contact 39 starts the mAs relay 38 which, however, excites the protective winding 37 only after the passing of approximately one second, meaning after the passing of a transition period. During this transition period the rotary anode motor 40 is accelerated, and the rotary anode of the X-ray tube 1 reaches its final rotational speed. At the exposure command, meaning with the closing of the contact 66, the timer switch 65 is started so as to effect a continual through-connection of the transistor 18 during three half-periods effects and thereby a rapid heating up of the heating filament 15. When the mAs-product which is measured at the measuring resistance 42 coincides with the reference value which is preset at the mAs-relay 38, the protective winding 37 is deactivated and opens the contact 36. Thereby, the X-ray exposure is then terminated.

While there has been shown what is considered to be the preferred embodiment of the invention, it will be obvious that modifications may be made which come within the scope of the disclosure of the specification.

What is claimed is:

1. In an X-ray diagnostic apparatus including an X-ray tube; a high-voltage transformer having a fixed idling output voltage; and a regulating circuit for the X-ray tube voltage, said circuit including a comparison element for comparing an actual value of the X-ray tube voltage with a reference value, and regulating means for the effective value of the filament current of the X-ray tube controlled by an output signal of said comparison element for correlating the actual value of the X-ray tube voltage to the reference value, the improvement comprising: a regulating circuit for the effective value of the filament current of said X-ray tube, said regulating circuit including an actual value transmitter and a reference value transmitter for the filament current of said X-ray tube, said reference value transmitter being adjustable responsive to actuation of regulating circuit for the X-ray tube voltage, said regulating means being connected in said circuit and influencing the effective value of the filament current for correlating the actual value to the reference value which is determined through the preset X-ray tube voltage.

2. An X-ray diagnostic apparatus as claimed in claim 1, said regulating means comprising a threshold value element having an adjustable threshold, an input of said element receiving a signal corresponding to the instantaneous value of the filament current effective value, and an output of said element including switch means for effecting the in-and-out switching of a heating filament transformer, the threshold of said threshold value element being variable responsive to the differences between the actual and reference values of the X-ray tube voltage and the actual and reference values of the filament current effective value.

3. An X-ray diagnostic apparatus as claimed in claim 2, said regulating circuit for the effective value of the filament current comprising a squaring element for a voltage corresponding to the instantaneous value of the filament current, and an integrator connected in series to said squaring element for forming a signal embodying the actual value of the filament current effective value of the X-ray tube, said integrator being switched back into its zero condition at the end of each half-wave of the voltage and having an output voltage transmitted to the input of said threshold value element.

4. An X-ray diagnostic apparatus as claimed in claim 2, said switch means being connected to said threshold value element in the filament circuit of said X-ray tube; and timer means operatively connected with said switch means for switching said switch means into a continual low-ohmic condition immediately after an X-ray exposure command for a short period compared to a transition time period between fluoroscopy and X-ray exposure.

5. An X-ray diagnostic apparatus as claimed in claim 2, comprising a series-connected diode and a parallel-connected condenser and discharge resistance being connected to said switch means associated with the threshold value element in the filament circuit of said X-ray tube, said diode being poled so as to prevent discharging of said condensor through the operative path of said swtich means.

* * * * *